US005642909A

United States Patent [19]

Swan et al.

[11] Patent Number: 5,642,909

[45] Date of Patent: Jul. 1, 1997

[54] LATCH SYSTEM

[75] Inventors: David A. Swan, Shoreview; Robert Gerald Lau, Anoka, both of Minn.

[73] Assignee: Federal-Hoffman, Inc., Anoka, Minn.

[21] Appl. No.: 609,356

[22] Filed: Mar. 1, 1996

[51] Int. Cl.[6] ..... E05C 9/12

[52] U.S. Cl. ..... 292/39; 292/25; 292/117; 292/160; 292/256.5; 292/244; 292/DIG. 57

[58] Field of Search ..... 292/9, 22, 23, 292/25, 30, 39, 116, 117, 156, 157, 142, 160, 256.5, 244, 41, 193, DIG. 57, 119

[56] References Cited

U.S. PATENT DOCUMENTS

| | | | |
|---|---|---|---|
| 4,616,864 | 10/1986 | Douglas | 292/39 |
| 5,172,944 | 12/1992 | Munich et al. | 292/39 |
| 5,481,889 | 1/1996 | Richard et al. | 292/39 |

FOREIGN PATENT DOCUMENTS

| | | | |
|---|---|---|---|
| 81685 | 11/1920 | Austria | 292/160 |
| 809075 | 12/1936 | France | 292/117 |
| 286041 | 7/1915 | Germany | 292/160 |
| 3710563C2 | 7/1992 | Germany . | |
| 9305893.4 | 6/1993 | Germany . | |

*Primary Examiner*—Rodney M. Lindsey

*Attorney, Agent, or Firm*—Merchant, Gould, Smith, Edell, Welter & Schmidt

[57] ABSTRACT

A latch system which includes a latch bar slidable up and down on an interior of an enclosure door. The latch system has a rack member mounted on the latch bar extending through an orifice in the door to engage an actuator on the exterior of the door. The latch bar has glides and retainer clips mounted to the latch bar for positioning the bar relative to the door. The door may include a gasket for sealing an enclosure, with the latch bar mounting outside of the sealed area. Retainer fingers include a roller which engage a latch catch mounted to the enclosure frame. The finger members and the rack members are reversible for mounting in either direction so that the door may be reversed at any time. The latch catches are configured for receiving a finger member at either end for engagement of the door.

19 Claims, 7 Drawing Sheets

LATCH SYSTEM

BACKGROUND OF THE INVENTION

1. Field of the Invention

The present invention relates to a latch system for an enclosure, and in particular, to a latch system reversibly mountable to the inside of a door.

2. Description of the Prior Art

Latch systems for enclosure doors are well known and take on a variety of configurations. Although latching systems in the prior art may work well for their intended use, they do not provide multiple mounting configurations and actuation flexibility for conveniently using with different enclosures.

Enclosures in factory environments and other industrial settings generally require the enclosure be sealed to prevent the entry into the enclosure of water, harmful fluids, dust, to prevent against accidents, and to prevent unauthorized usage. Latching systems used with such enclosures either must be sealed or the utility of the enclosure is decreased. Often times, an additional housing or elaborate sealing system is needed to enclose portions of the latch system to reduce entry of unwanted substances.

In addition, the latch systems of the prior art generally require a specific handle for actuating the latch system. It can be appreciated that under various conditions of use, various types of handles may be required depending on the harshness of the operating environment, the security needs, the accessibility, and the level of protection required for the elements inside the enclosure.

An example of a prior art latching system is shown in German Patent No. G 93 05 893.4. Although this latch system provides a latching system mounted on the interior of the door, it requires an intermediate rack member mounted on the exterior of the door to engage the actuator handle. In addition, the complicated latch handle and gear mechanism mounted on the exterior of the door make providing a sealed interior environment more difficult.

It can be seen, then, that a new and improved locking system for an enclosure is needed which utilizes components which provide for latching when a door is opened to either the left or the right. In addition, such a latch system should allow for either clockwise or counterclockwise rotation of a handle for actuating the system. In addition to the direction of the handle, the type of handle which may be used should also be variable with the system, as well as the level of security and the type of locking system and should be mounted to the exterior of the door. In addition to providing flexibility afforded by these options, the flexibility of the latching system should provide for changing the various features of the latching system during the life of the enclosure, rather than just prior to installation. The present invention addresses these as well as other problems associated with enclosure latching systems.

SUMMARY OF THE INVENTION

The present invention is directed to a latching system, and in particular, to a reversibly mounted latching system for a sealed industrial enclosure.

It is an object of the present invention to provide a latching system which does not occupy any of the usable enclosure space. The latch system should be outside of the gasketed area of the enclosure, providing an externally mounted latch.

A further object of the present invention is to provide a latch system which provides for reversing the door mounting position and operating direction and for reversing the direction of the actuating handle swing.

Another object of the present invention is to provide a latch system actuatable by simple tools, specialty tools, a variety of handle designs and which can accommodate a variety of locking options.

Yet another object of the present invention is to provide a latch system which pulls the door toward the frame during the latching operation, thereby providing compression of the sealing gasket and a better seal for the enclosure.

A yet further object of the present invention is to provide a latch system with motion limiting at both the latched and unlatched positions.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT

Figure 1:
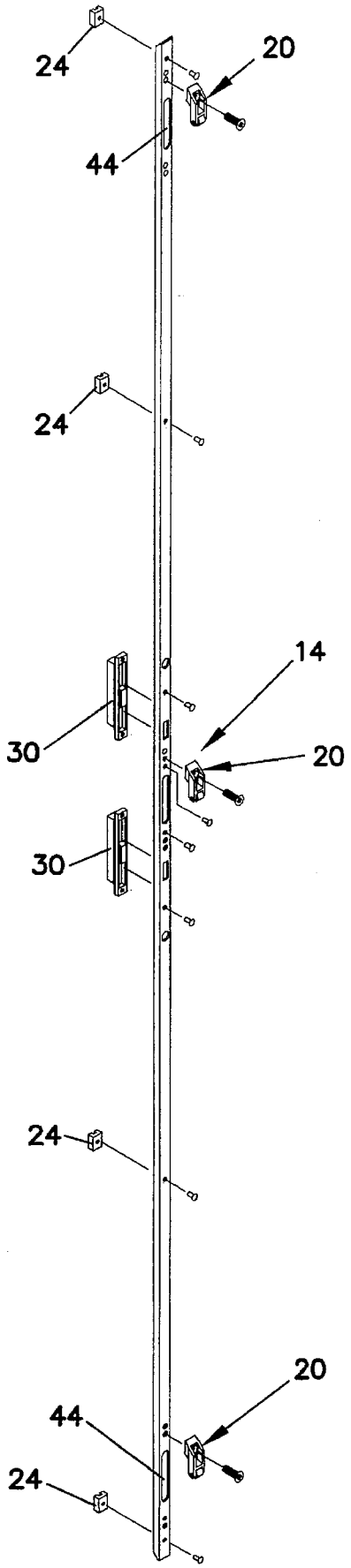
FIG. 1 shows an exploded perspective view of a latch system according to the principles of the present invention.
Figure 2:
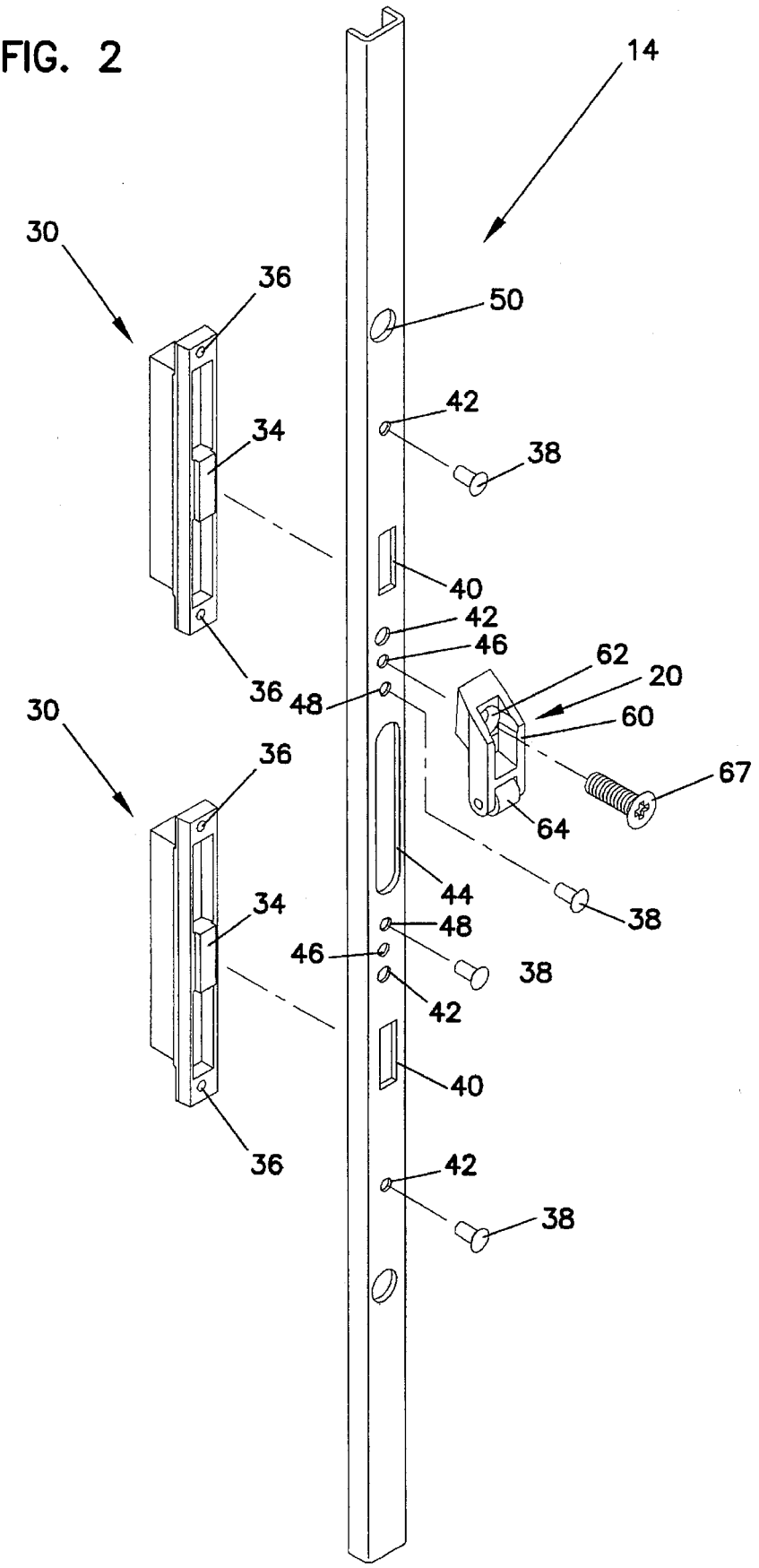
FIG. 2 shows a detail view of the rack and pinion assembly of the latch system shown in FIG. 1.
Figure 3:
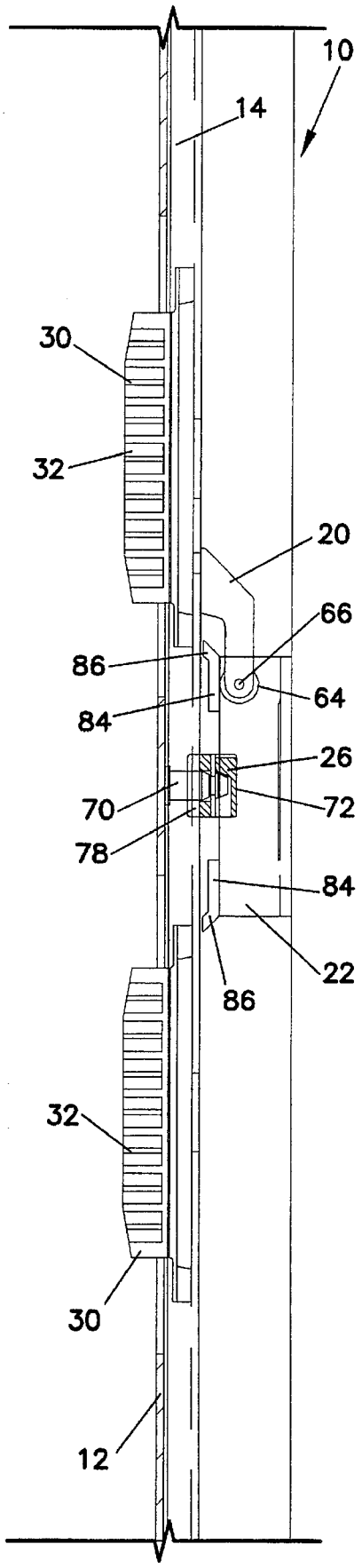
FIG. 3 shows a side sectional view of the door and latch system shown in FIG. 1.
Figure 8:
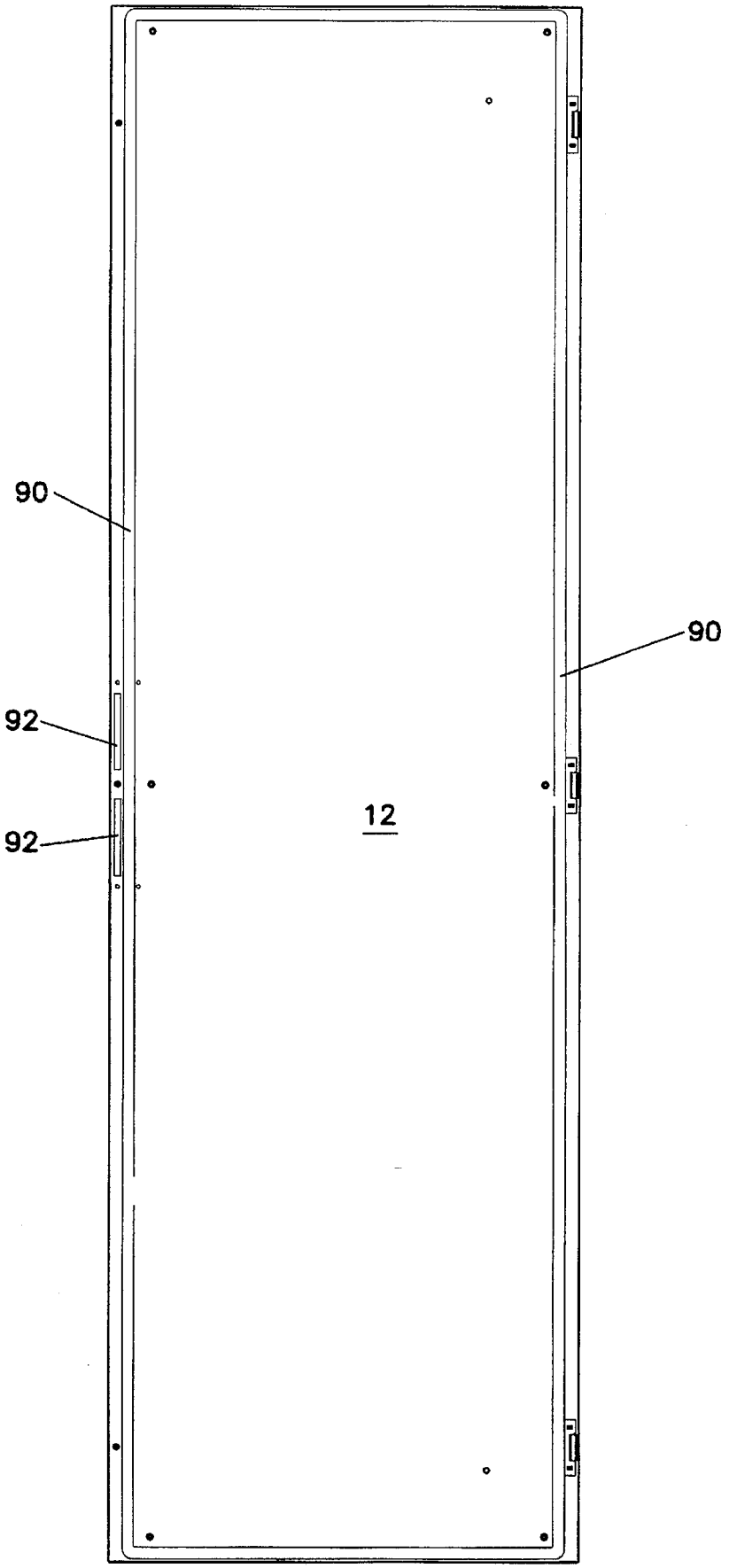
FIG. 8 shows a front elevational view of a door configured for receiving the latching system shown in FIG. 1.

Referring now to the drawings, and in particular to FIGS. 1–3, there is shown a latch system, generally designated 10. The latch system 10 mounts to an enclosure door 12, as shown in FIG. 8. In the preferred embodiment, the latch system 10 mounts to the interior of the door 12 and extends through the door only at orifices 92, as explained hereinafter, positioned outside of a gasket 90. The gasket 90 engages an enclosure frame 11 and provides for a sealed enclosure.

Figure 9:
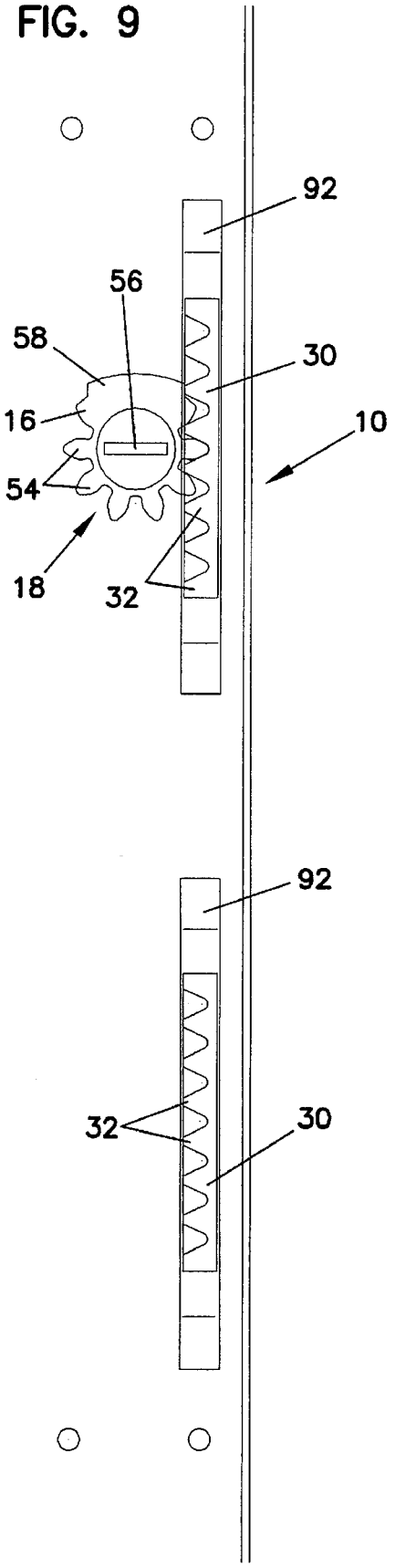
FIG. 9 shows a front elevational view of latching portion of the door and the latch system shown in FIG. 1.

Referring again to FIGS. 1–3, the latch system 10 includes a latch bar 14 mountable to the inside of the door 12. The latch bar 14 includes a rack and pinion assembly 18 with one or more rack members 30 extending through the orifice 92, as shown in FIG. 3, to engage an actuator 16 on the exterior of the door 12, as also shown in FIG. 9. The actuator 16 can take on a number of configurations which provide for actuating the latch system 10. The actuator 16 may be configured for rotation by a tool or connection to a handle, depending on the needs of the enclosure and its environment. In the embodiment shown in FIG. 9, the actuator 16 includes a tool receiving portion 56 and teeth 54 configured for intermeshing with the rack members 30, as explained hereinafter. The actuator 16 also includes a stop portion 58 to limit rotation of the actuator 16. In addition, the latch system 10 is adaptable for receiving a lock or other actuator mountable on the exterior of the door 12. It can be appreciated that the actuator 16 is mounted entirely on the exterior of the door 12, while the latching system 10 is mounted on the interior of the door. Only the rack members 30 extend through the orifices 92 to engage the actuator 16. With this configuration, sealing is much easier than systems requiring a number of components mounted through the door 12 inside of the gasketed region of the enclosure.

As shown in FIGS. 1 and 2, the latch bar includes a number of finger members 20 which engage latch catches 22 which mount to the enclosure frame 11, as shown in FIG. 3. The latch bar 14 also includes glides 24 mounted thereon which slide against the door surface and mounting clips 26 which retain the latch bar 14 substantially against the door 12.

Figure 4:
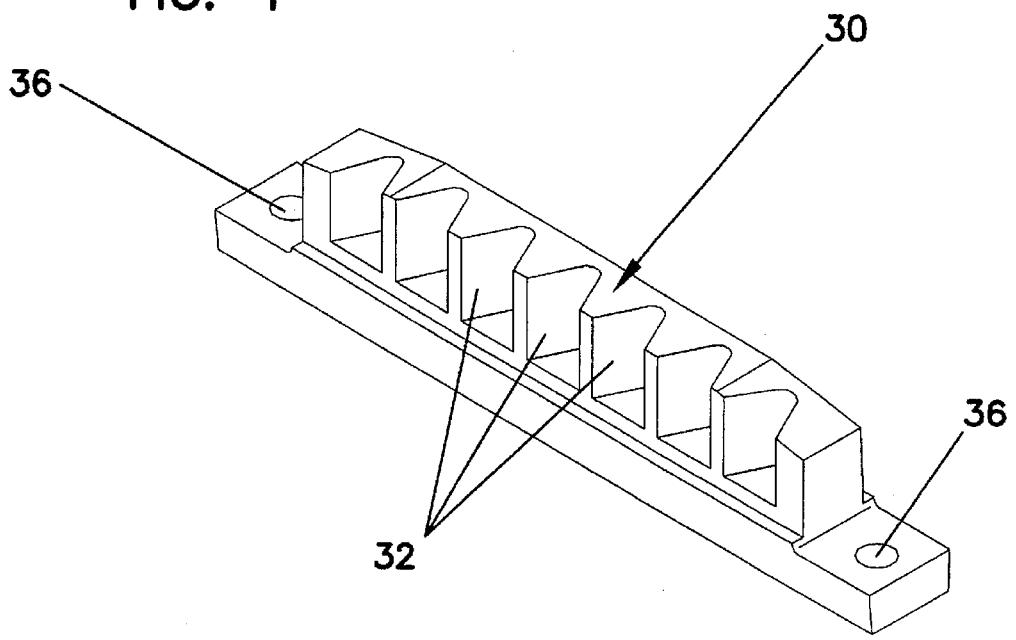
FIG. 4 shows a perspective view of a rack member for the rack and pinion assembly shown in FIG. 2.

Referring now to FIG. 3, the latch system 10 mounts on the interior of the door 12 with the rack members 30 extending through the orifice 92 to engage the actuator 16, which mounts entirely on the exterior of the door 12. The other elements of the latch system 10 attached to the latch bar 14 are all on the interior of the door 12. The rack members 30 includes a number of teeth 32 aligned along an elongate portion, as shown in FIG. 4 and engaging the actuator 16, as shown in FIG. 9. The rack member 30 also includes a tab 34 extending in an opposite direction from the teeth 32 which inserts through an elongate slot 40 formed through the latch bar 14, as shown most clearly in FIG. 2. The latch bar 14 is a substantially U-shaped channel member with slots and orifices formed through the bottom portion of the channel for receiving various latch system elements, as explained hereinafter. The ends of the rack member 30 include mounting bores 36 which receive screws 38 which mount to holes 42 formed in the base of the channel of the latch bar 14. It can be appreciated that the tab 34 extending through the slot 40 aligns the rack member 30. It can also be appreciated that the rack members 30 may be reversibly mounted in the channel of the latch bar 14 so that the actuator 16 may be used with different door configurations and mounted to engage the rack members 30 on either side of the orifice 92 formed through the door 12 and also provides for reversing the door 12 for opening to either the left or the right.

Figure 5:
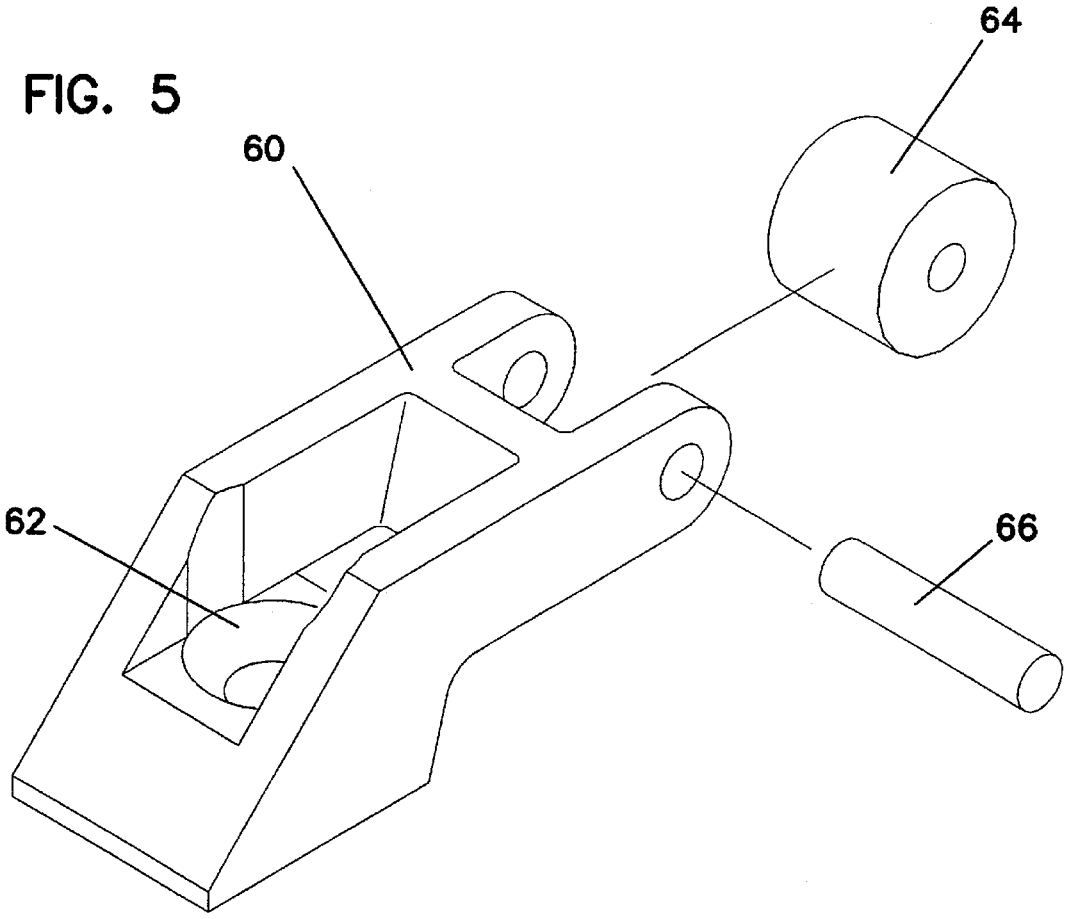
FIG. 5 shows an exploded perspective view of a latch finger and roller for the latch system shown in FIG. 1.

Referring now to FIG. 5, there is shown a finger member 20 which extends upward from the latch bar 14 opposite the direction of the channel. The finger member 20 includes an extended raised finger portion 60 and a mounting orifice 62 which receives a screw or other mounting hardware 67 for attaching the finger member 20 to the latch bar 14. In addition, the finger member 20 includes a roller 64 mounted on a pin 66 at the extended end of the finger portion 60. The roller 64 is preferably a low friction material for easier engagement with the latch catch, as explained hereinafter. It can be appreciated that the finger member 20 also includes a center mounting post which inserts through the center hole 46, while the screws 67 insert into the holes 48 shown in FIG. 1. It can be appreciated that the finger member 20 may be positioned to extend in either direction and then the mounting screw may be attached to the latch bar 14. This provides for easy reversibility of the finger members 20, which provides for reversibility of the door 12.

The glides 24 mount into and extend from the channel portion of the latch bar 14 and are typically low friction plastic members which mount through orifices 50 in the latch bar 14 with screws 52 or other mounting hardware. The glide members 24 extend slightly beyond the channel portion of the latch bar 14 so that as the latch bar is slid back and forth, the glide members 24 engage the door surface to provide for reduced friction and easier movement of the latch system 10.

Figure 6:
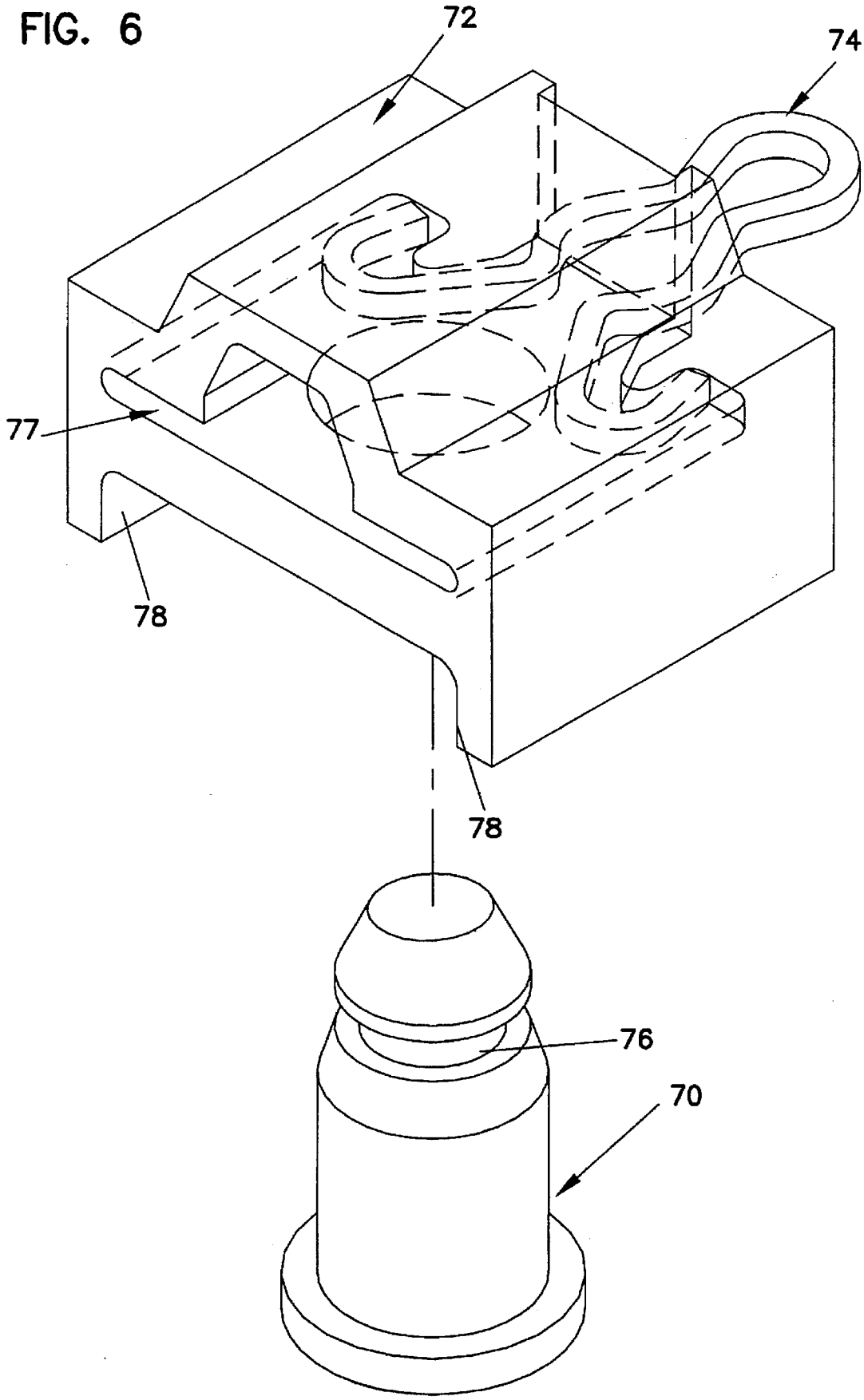
FIG. 6 shows an exploded perspective view of a mounting clip for the latch system shown in FIG. 1.

As shown in FIG. 6, the mounting clip 26 includes a stud portion 70 typically mounting to the interior surface of the door 12, as shown in FIG. 3. The stud 70 includes a groove 76 formed therein and a tapered end portion which provides for easy insertion into the clip housing 72, as explained hereinafter. A cotter type pin 74 extends through a slot 77 in the housing and engages the groove in the stud 76. The pin 74 is removably mounted and provides for easily disengaging the housing 72 from the stud 70.

The mounting clip 26 extends through a slot 44 formed in the latch bar 14. The stud 70 extends through the slot, while the housing 72 engages the exterior of the base of the latch bar 14 with side portions 78 aligning and retaining the latch bar. In this manner, the latch bar 14 is retained against the door 12. In the preferred embodiment, the housing 72 is also formed with plastic to reduce friction, while the latch bar slides 14 against the housing. It can be appreciated that the stud portion 70 slides within the slot 44 to limit the motion of the latch bar 14. In this manner, rotation of the actuator 16 to move the racks 30 back and forth is limited by the length of the slot 44, as the slots 44 engage the studs 70.

Figure 7:
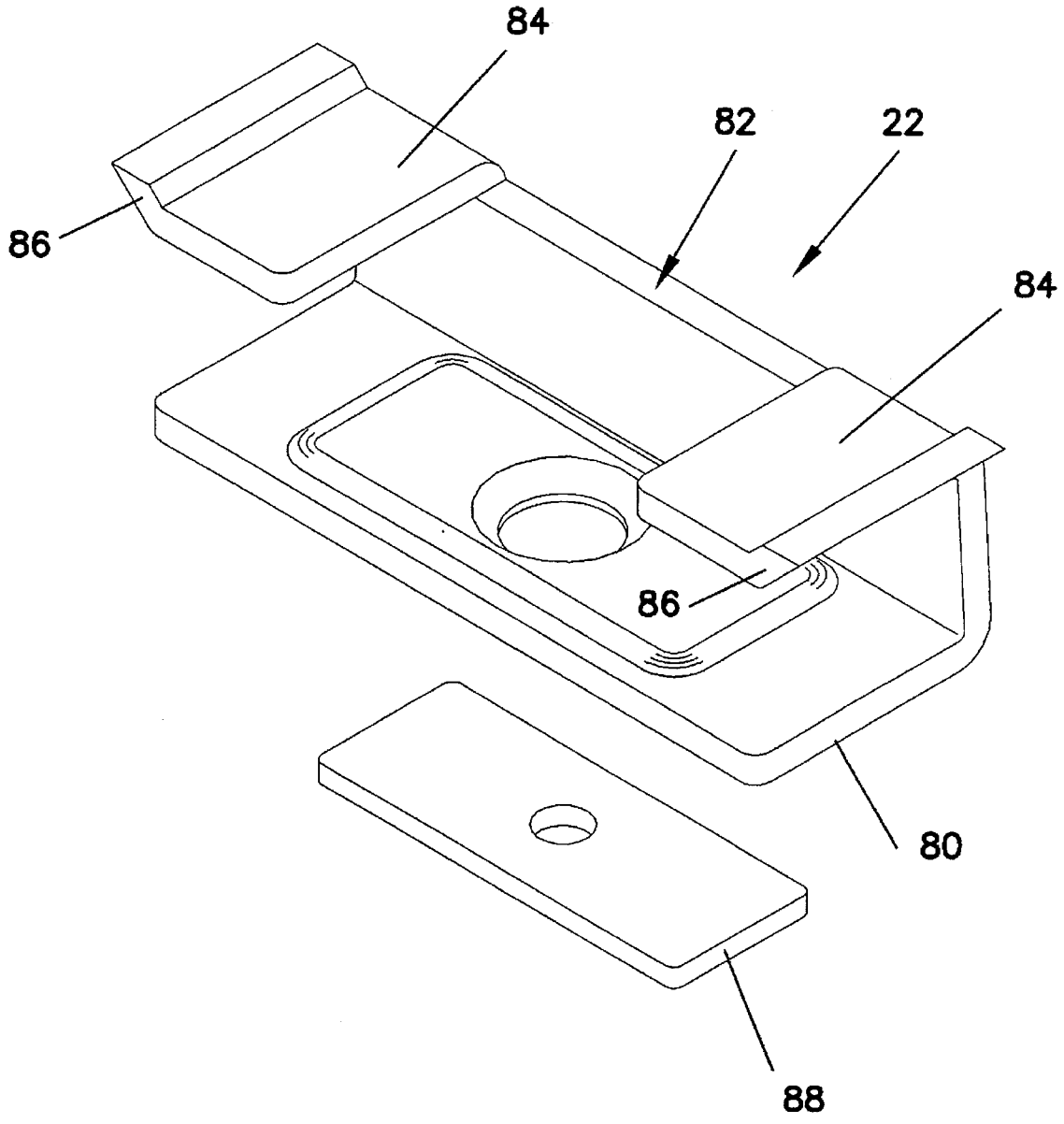
FIG. 7 shows a perspective view of the latch catch for the latching system shown in FIG. 1.

Referring now to FIG. 7, the latch catch 22 includes a base 80 which may be configured for receiving a gasket 88 for sealing against the enclosure 11, as shown in FIG. 3. In addition, a riser portion 82 extends upward to support oppositely positioned retainer members 84. The retainer members 84 each include an upward angled portion 86 extending outward longitudinally from each end of the latch catch 22. The latch catch 22 is mounted so that when the door is closed, the rollers 64 of the finger members 20 engage the angled portion 86 of the latch catch 22. The angled portion 86 acts as a ramp to guide the finger members 20 into engagement with the latch catch 22 so that the finger portion 60 properly engages the retainer member 84 of the catch 22. The latch catch 22 and the finger member 20 provide tight closure and some pressure against the gasket for a tight, sealed environment on the interior of the enclosure. It can be appreciated that with the configuration of the latch catch 22, the retainer members 84 are positioned on either end of the latch. This configuration provides for engagement from either end of the latch catch 22 by a corresponding finger member 20. The operating direction of the door 12 is reversible so that the latch catch 22 may be used with doors opening to either the left or the right without requiring two differently configured parts.

It can be appreciated that with the present invention, the latch system 10 provides for great flexibility in mounting, and especially for mounting with a sealed enclosure. The latch system 10 mounts substantially on a latch bar 14 which requires extension through the door 12 only for the rack members 30. The door 12 is modified only by forming orifices 92 therethrough for accepting the latch system 10. The latch bar mounts on mounting studs 70 which are typically welded to the interior of the door 12. In addition, the present invention provides for a latch system 10 which is mounted exterior of the sealing gaskets 90 of the door 12. In this manner, greater flexibility and ease of use is provided, while still maintaining a dust-free and water-tight sealed enclosure.

The latch system 10 can be reversed at any time for changing the direction of the door 12 from opening to either the left or the right. The latch system 10 includes reversible rack members 30 and reversible finger members 20 which engage latch catches 22 which are configured for accepting engagement of the finger member 20 at either end. The actuator 16 is mounted entirely exterior of the door 12 so that the actuator 16 may also be reversed to engage either of the rack members 30. The latch system 10 also engages the actuator 16 which may be configured for moving the latch system with rotation in either a clockwise or counterclockwise direction, depending upon the needs of the enclosure, as the stop portion 58 may be repositioned to limit rotation as needed. The latch system 10 also requires little modification should there be locking requirements, as hardware is mountable exterior of the door 12 with the actuator 16.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A latch system for an enclosure having a door, comprising:

a latch bar for mounting on a first side of the door;

actuating means for mounting on a second side of the door;

a rack member mounted on the latch bar having a plurality of teeth formed therein; and, wherein the door includes an orifice formed therein and wherein the rack member is extendable from the first side of the door through the orifice to engage the actuating means on the second side of the door.

2. A latch system according to claim 1, wherein the latch bar is slidably mountable between an engaged position and a release position.

3. A latch system according to claim 1, wherein the latch bar comprises a U-shaped bar forming a channel.

4. A latch system according to claim 3, wherein the rack member inserts into the channel of the latch bar.

5. A latch system according to claim 1 wherein the teeth of the rack member are extendable substantially parallel to a surface of the door.

6. A latch system according to claim 1, further comprising engagement means mounted on the latch bar on a side opposite the rack member for engaging the enclosure.

7. A latch system according to claim 6, wherein the engagement means comprises a finger member extending from the latch bar.

8. A latch system according to claim 7, wherein the finger member includes a roller mounted thereon.

9. A latch system according to claim 1, further comprising guides mounted on studs extending through corresponding slots formed in the latch bar, and wherein motion of the latch bar is limited by the studs engaging the ends of the slots.

10. A latch system according to claim 1, wherein the latch system comprises a reversibly mountable rack member.

11. A latch system according to claim 1, wherein the latch system comprises a reversibly mountable finger member.

12. A latch system according to claim 1, wherein the teeth of the rack member are extendable through the door.

13. A latch system according to claim 1, wherein the actuation means comprises a rotatable gear having teeth formed thereon engaging the rack member teeth.

14. A latch system according to claim 7, further comprising a latch catch for mounting on the enclosure including a retaining member engaging the finger member of the latch bar.

15. A latch system according to claim 14, wherein the retaining member comprises an angled guide portion engaging the finger member.

16. A latch system according to claim 15, wherein the latch catch comprises a pair of retaining members having guide portions extending in opposite directions.

17. A latch system according to claim 3, further comprising glide blocks mounting in the latch bar channel and slidably engageable with the door.

18. A latch system for an enclosure having a door, comprising:

a latch bar for mounting on a first side of the door;

actuating means for mounting on a second side of the door;

a reversibly mountable rack mounted on a first side of the latch bar having a plurality of teeth formed therein; wherein the door includes an orifice formed therein and wherein the rack is extendable through the orifice to engage the actuating means;

a reversibly mountable finger member mounted on a second side of the latch bar; and, a latch catch engaging the finger member in a closed position and including means for engaging the finger member when the finger member is reversibly mounted.

19. A latch system according to claim 18, wherein the rack and the finger member are selectively positionable at different locations along the latch bar.

* * * * *